United States Patent [19]

Beurskens et al.

[11] Patent Number: 4,622,488

[45] Date of Patent: Nov. 11, 1986

[54] INTERNALLY FUSED ELECTRIC LAMP WITH PARTIALLY EMBEDDED FUSE WIRE

[75] Inventors: Johannes H. H. Beurskens; Bauke J. Roelevink, both of Weert, Netherlands

[73] Assignee: U.S. Philips Corporation, New York, N.Y.

[21] Appl. No.: 623,047

[22] Filed: Jun. 21, 1984

[30] Foreign Application Priority Data

Jun. 29, 1983 [NL] Netherlands ..... 8302306

[51] Int. Cl.[4] ..... H01J 5/62; H01J 5/50

[52] U.S. Cl. ..... 313/318; 313/315

[58] Field of Search ..... 313/318, 315

[56] References Cited

U.S. PATENT DOCUMENTS 3,346,768 10/1967 Patsch ..... 313/318 X 3,413,511 11/1968 Plagge ..... 313/318

4,216,406 8/1980 Björkman et al. ..... 313/318 X

FOREIGN PATENT DOCUMENTS 46-21075 6/1971 Japan ..... 313/318

1060297 3/1967 United Kingdom .

*Primary Examiner*—David K. Moore

*Assistant Examiner*—Vincent DeLuca

*Attorney, Agent, or Firm*—David R. Treacy

[57] ABSTRACT

A lamp includes a tube which forms part of a sealed vessel, extending between a lamp cap and a pinch at an end of the tube inside the vessel. A current supply conductor extending between a cap contact and a light source inside the vessel includes a fuse wire portion which is embedded in an electrically insulated mass within the tube, part of the fuse wire portion being free of the insulating mass, between the mass and the lamp cap.

9 Claims, 1 Drawing Figure

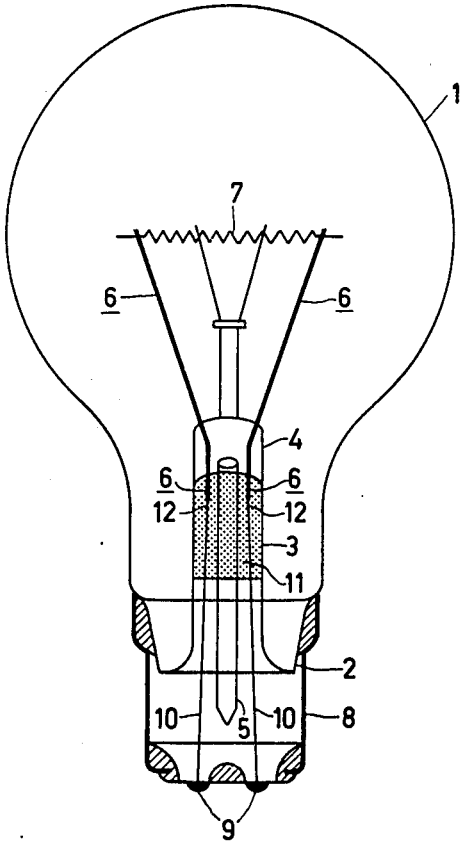
1
7
6
6
4
6
6
12
12
3
11
2
10
5
10
8
9

INTERNALLY FUSED ELECTRIC LAMP WITH PARTIALLY EMBEDDED FUSE WIRE

BACKGROUND OF THE INVENTION

The invention relates to an electric lamp comprising a lamp vessel which is closed at one end with a tube which extends into the lamp vessel and is sealed to current-supply conductors in a vacuum-tight manner at an end located inside the lamp vessel by means of a pinch. The current supply conductors are connected to respective contacts at the bottom of the lamp cap, and include a fuse wire which extends through an electrically insulating mass arranged between the relevant contact and the proximity of the pinch. Such a lamp is known from British Pat. No. 1060297 (General Electric Company, Mar. 1, 1967).

It is of great importance that electric lamps are provided with a fuse to interrupt the current circuit when an excessively high current flows through the lamp. However, when the fuse melts, a discharge arc can be produced which can flash over to the other current-supply conductor or to the sheath of the lamp cap. Such a discharge arc can weld the lamp cap to the lamp holder, blow the fuse of the equipment to which the lamp is connected, or cause the lamp to explode. Therefore, numerous proposals have been made to avoid these phenomena. In many cases, these proposals require additional parts to be used, as a result of which the manufacture of the lamp becomes more expensive.

In the lamp according to the aforementioned British patent, the tube is filled with quartz sand or with glass beads, the lamp cap is fixed on the lamp vessel and sealed with cement, and the lamp cap is filled for the remaining part with foamed synthetic material. As a result, the fuse is entirely incorporated in electrically insulating material and a discharge arc cannot be produced.

The foamed material in this lamp has a double function: it holds the grains of sand or glass in place and it insulates the fuse from the other current conductor and from the lamp cap (except for the relevant contact at the lamp cap).

It has been found that in practice this construction has great disadvantages. The synthetic material, from which the foam is formed upon heating, has to be pressed to form rings which are then fixed in the lamp cap. During the process of assembling the lamp vessel and the lamp cap, the lamp vessel should be arranged with its neck directed upwards in order to prevent the grains of glass or sand from flowing away, which implies that the lamp cap should be arranged with its opening downwards. The price of the lamps is increased by the steps of pressing the rings and fixing them. Moreover, this construction has the great disadvantage that while moving between the production machine for lamp caps and the assembling machine for lamps, the rings of foamed synthetic material can drop out of the lamp cap. As a result, the assembling machine should be provided with means for checking the presence of the rings in order to avoid producing some lamps in which the fuse wire is not satisfactorily enclosed by insulating material.

SUMMARY OF THE INVENTION

The invention has for its object to provide a lamp provided with a fuse which is of a very simple construction.

According to the invention, this is achieved in a lamp of the kind described in the opening paragraph, in that a fuse wire is present in a current-supply conductor connected to a bottom contact of the lamp cap, and in that a coherent electrically insulating mass is provided in the tube adjacent the pinch. The fuse wire is embedded over only part of its length in the mass, and the mass remains coherent at the temperatures prevailing at that location during operation of the lamp.

In contrast with the teachings according to the prior part, experiments have shown that it is not necessary for a safe and reliable fuse that the fuse wire be incorporated throughout its length in an insulating mass, or that the end of the fuse wire connected to or located near the relevant contact of the lamp cap be embedded in an insulating mass. It is in fact sufficient if only the end of the fuse wire located near the pinch is incorporated in an insulating mass. This is probably due to the fact that, when the fuse wire becomes operative and melts away, the comparatively thick current-supply conductor extending through the pinch into the tube and connected to the fuse wire cannot act as an electrode for a discharge arc. The thick current-supply conductor is in fact only accessible for an arc through the narrow duct in the insulating mass which still was filled beforehand by the fuse wire.

Although the tube may be filled for a large part, or even entirely, with the insulating mass, this is not necessary. Generally, it is sufficient if the fuse wire is embedded over about 12 mm of its length. This has the advantages of low material consumption, small weight and a rapid manufacture. Especially when an exhaust extends through the said tube to the pinch, the space inside the said tube is very restricted and a very low amount of material suffices to embed the fuse wire. Due to the fact that the fuse wire need be incorporated in the insulating mass over only part of its length, it is not necessary for the fuse wire to be secured to a thick wire which is secured to a contact on the lamp cap, as is the case in certain known constructions.

The insulating mass can be provided in a controllable manner because this can be effected before the lamp cap is fitted. The mass can be provided whilst the lamp vessel is in the same position as is usual during the arrangement of the lamp cap: the end to which the lamp cap has to be secured is then directed upwards. This has the great advantage that an insulating mass cross-linking and/or foaming at the ambient temperature can be used, which is obtained immediately before the application by mixing two components. A thermal treatment can then be dispensed with. If the mass should have to be put into the lamp cap or if the lamp cap should also have to be filled, the use of such cold-hardening or cold-foaming masses would be objectionable in view of the time required to arrange the lamp cap on the lamp vessel.

A strong adherence of the insulating mass to the tube has proved not to be necessary because the mass is enclosed sufficiently by the tube, the current-supply conductors and the exhaust mostly present so that it is held in place. Very favorable results have been obtained with foams, such as silicone polyester foams and especially with polyurethane foams.

The lamp according to the invention may be any one of several kinds. The light source may be a filament, which may be provided in an inner envelope, or a filament and a discharge arc, in which case the filament serves at the same time as a current limiter for the discharge arc. Furthermore, the lamp may have an Edison lamp cap or a Swan lamp cap, while a contact may be present on the sheath of the lamp cap.

Among the large number of known constructions of lamps with a fuse, in which additional parts are required for entirely enclosing the fuse wire, the construction according to German Gebrauchsmuster No. 1,912,570 is mentioned. In this case, the fuse wire is a part of a current-supply conductor located entirely in the tube of the lamp and the tube is filled entirely with quartz sand covered with a glue layer in order to prevent the sand from flowing away. Not only does this construction require glue as well as sand, but also a thicker piece of wire has to be welded to the fuse wire in order to bridge the distance between the fuse wire located entirely in the tube and the contact on the lamp cap.

BRIEF DESCRIPTION OF THE DRAWING

The sole FIGURE is a side elevation, partly in section, of an embodiment of a lamp according to the invention.

DESCRIPTION OF THE PREFERRED EMBODIMENT

The glass lamp vessel 1 is closed at an end 2 with a glass tube 3 which extends into the lamp vessel and is connected at its end located inside the lamp vessel 1 by means of a pinch 4 to an exhaust tube 5 and current-supply conductors 6 which lead to a light source 7 arranged inside the lamp vessel 1. The lamp vessel 1 is secured at its end 2 to a lamp cap 8 whose contacts 9 are connected to the current-supply conductors 6. The current-supply conductors 6 each consist, between the contacts 9 and the proximity of the pinch 4, of a fuse wire 10. The tube 3 contains a coherent electrically insulating mass 11 in which the end 12 of the fuse wires 10 located near the pinch 4 is embedded.

A few hundreds of lamps of the kind shown in the drawing were manufactured in which the coherent insulating mass was a polyurethane foam obtained from propylene glycol and an excess of methylene diphenyl di-isocyanate with halogenated hydrocarbon and water as foaming agent. Invariably, the fuse wire was embedded at its end over a length of from 1.5 to 2 cm. Several of these lamps were operated at nominal voltage till the end of the life. They then consumed at 220 V a power of 100 W. The temperature of the insulating mass was 250° C. At the end of the calculated life the filament burned through, and at least one of the fuse wires of the lamps fused. The current flow through the lamps was then interrupted without the occurrence of additional phenomena.

Lamps of the same kind were operated for 750 hours, which is 75% of the calculated life. 50°–70° before the maximum of the line voltage across the lamps was reached (that is, before the peak of the alternating voltage waveform), an excess voltage of 3000 V was applied across the lamps for 2 to 5 milliseconds. As a result, the filament burned through and an arc discharge was produced inside the lamp vessel. The arc extinguished 1.5 msec after it was produced due to the melting of at least one of the fuse wires. No discharge arcs then occurred inside the lamp cap. The 10 A fuse of the equipment was then still intact, while the lamp, except for the filament and the fuse wire(s) was also still intact.

Lamps of the same kind were held for 1500 hr at 250° C. and were then tested, in the same manner as to the reliability of the fuse with the same result. In lamps without an insulating mass, the current through the lamp increased in 4 msec to 35 A and the lamp vessel became fixed in the lamp holder by welding.

What is claimed is:

1. An internally fused electric lamp comprising:

a lamp vessel enclosing an inner space, and having a tube extending inwardly, said vessel being sealed in a vacuumtight manner by means including a pinch at an end of the tube inside the vessel, a light source arranged in said space, a lamp cap having electrical contacts, secured to the vessel, and arranged such that the tube communicates with the cap, two current supply conductors, each extending from a respective contact through said tube and pinch to said light source, a portion of at least one of said conductors consisting of a fuse wire, and a mass of electrically insulating material through which said fuse wire passes, characterized in that said mass is disposed in said tube adjacent said pinch, a first portion of said fuse wire is embedded in said mass, and a second portion of said fuse wire is free of said mass and is between said mass and the respective contact, and said insulating mass is formed of a material which is coherent at temperatures occurring in the mass during normal operation of the lamp.

2. A lamp as claimed in claim 1, characterized in that said at least one of said conductors consists of said fuse wire portion and a comparatively thick conductor portion extending between said fuse portion and said light source and extending through said pinch.

3. A lamp as claimed in claim 2, characterized by comprising two said current supply conductors, each including a respective said fuse wire portion.

4. A lamp as claimed in claim 3, characterized in that said insulating mass is a synthetic material which is hardened in place.

5. A lamp as claimed in claim 3, characterized in that said insulating mass is a synthetic material which is foamed in place.

6. A lamp as claimed in claim 2, characterized in that said insulating mass is a synthetic material which is hardened in place.

7. A lamp as claimed in claim 2, characterized in that said insulating mass is a synthetic material which is foamed in place.

8. A lamp as claimed in claim 1, characterized in that said insulating mass is a synthetic material which is hardened in place.

9. A lamp as claimed in claim 1, characterized in that said insulating mass is a synthetic material which is foamed in place.

* * * * *